US007521088B2

(12) United States Patent
Medford et al.

(10) Patent No.: US 7,521,088 B2
(45) **Date of Patent: *Apr. 21, 2009**

(54) PROCESS FOR CORROSION PROTECTION OF TURBINE INTERNAL COMPONENTS

(75) Inventors: Glenn M. Medford, Duncan, SC (US); Billy M. Paderick, Jr., Seven Springs, NC (US); Joseph W. Hirtz, West Point, VA (US); Robert A. Cardin, Greenville, SC (US)

(73) Assignee: General Electric Company, Schenectady, NY (US)

( * ) Notice: Subject to any disclaimer, the term of this patent is extended or adjusted under 35 U.S.C. 154(b) by 797 days.

This patent is subject to a terminal disclaimer.

(21) Appl. No.: 10/945,896

(22) Filed: Sep. 22, 2004

(65) Prior Publication Data

US 2006/0062911 A1 Mar. 23, 2006

(51) Int. Cl.
*B05D 7/22* (2006.01)
*B05D 5/00* (2006.01)

(52) U.S. Cl. ..... 427/236; 427/237; 427/238

(58) Field of Classification Search ..... 427/230, 427/236, 237, 238

See application file for complete search history.

(56) References Cited

U.S. PATENT DOCUMENTS 4,708,590 A * 11/1987 Bronowski et al. ..... 415/163
5,647,906 A * 7/1997 Monday et al. ..... 118/70
6,010,746 A * 1/2000 Descoteaux et al. ..... 427/142
6,841,195 B2 * 1/2005 Kunder et al. ..... 427/237

* cited by examiner

*Primary Examiner*—William Phillip Fletcher, III
(74) *Attorney, Agent, or Firm*—Nixon & Vanderhye P.C.

(57) ABSTRACT

A method and system of applying a corrosion inhibitor to the interior component parts of a turbine to provide corrosion protection to the components is disclosed. The intake and exhaust openings in the turbine are sealed using plastic and/or metal covers to contain the corrosion inhibitor inside the turbine. An air horn connected to an outlet vent in one of the covers induces air into and from the turbine's interior. A fog of corrosion inhibitor is introduced into the turbine through at least one inlet vent in a different cover located diagonally at an opposite end of the turbine. A sprayer is used for introducing the corrosion inhibitor into the inlet vent while the air horn is operating so that the corrosion inhibitor is caused to be drawn into and through the interior of the turbine to coat the interior component parts of the turbine. The corrosion inhibitor is introduced into the inlet vent until the corrosion inhibitor coats all exposed surfaces of the components inside turbine. The selection of vents as inlet and outlet vents and the positioning of the air horn and sprayer are then altered to allow a reverse flow of the fog to again saturate the turbine internals with corrosion inhibitor. All openings in turbine are subsequently sealed to contain the corrosion inhibitor inside the turbine.

40 Claims, 12 Drawing Sheets

PROCESS FOR CORROSION PROTECTION OF TURBINE INTERNAL COMPONENTS

BACKGROUND OF THE INVENTION

The present invention relates to corrosion protection for gas turbine components, and in particular, to a process for providing corrosion protection for the internal components of a gas turbine in the complete flow path of gas or steam.

Gas turbines typically include components with parts that are made from iron. These parts typically include the internal bores of the casings, the rotor blades and spacers, combustion hardware and rotor bolting. These parts are critical components on gas turbines from a functional and performance standpoint. Typically, after a turbine has been assembled and tested, it is shipped to a location where it is either installed or stored for later installation. Often, during the time between a turbine leaving a manufacturing facility and its subsequent installation and startup at a power plant, the components of the turbine that include iron parts will rust. The development of rust on such component parts can significantly compromise the performance of the turbine. The rust can change the turbine's airfoil profile and thereby affect performance. Rust can also block up cooling holes and orifices. The presence of rust on a new turbine can also affect a customer's perception of the quality of the turbine being delivered and the ability of the turbine's manufacturer to deliver a satisfactory product.

There have been prior efforts to solve the problem of rust forming on iron turbine component parts. One method currently used to protect turbine components from the formation of rust involves stuffing paper impregnated with volatile corrosion inhibitors ("VCI") into the inlet and exhaust cavities of the turbine to seal the cavities. VCI paper can help mitigate the beginning of corrosion, but must be kept dry. The problem with this method is that it provides corrosion protection only in the areas where the VCI paper is used.

Another method currently used involves installing a closed loop dehumidification system in the turbine to direct warm, dry air over the turbine's iron component parts. However, the effectiveness of this method is limited since it provides protection only to those turbine components directly in the flow path of the warm, dry air directed through the turbine by the dehumidification system. It does not protect any components that are not directly in the flow path of the warm, dry air. Thus, it would be desirable to provide a method of providing corrosion protection to all exposed surfaces of components inside the flow path of a turbine, such as casing walls and cavities, buckets, blades, nozzles, vanes, shafts, seals, combustors and cooling passages.

BRIEF DESCRIPTION OF THE INVENTION

A In an exemplary embodiment of the invention, a method of applying a corrosion inhibitor to the interior component parts of a turbine to provide corrosion protection to the components comprises the steps of sealing each intake opening and each exhaust opening in the turbine with a cover, forming at least one intake port one and at least one exhaust port in the intake opening seals and the exhaust opening seals, respectively, and introducing a stream of air into the turbine's interior through the at least one intake port, introducing a fog of the corrosion inhibitor into the stream of air entering the turbine so that the corrosion inhibitor is caused to be drawn into and through the interior of the turbine to coat the interior component parts of the turbine, exhausting the fog of corrosion inhibitor and the stream of air being introduced into the turbine's interior through the at least one exhaust port and subsequently sealing each opening in the turbine with a cover to contain the corrosion inhibitor inside the turbine.

In another exemplary embodiment of the invention, a method of applying a corrosion inhibitor to the interior component parts of a turbine to provide corrosion protection to the components comprises the steps of providing an air horn connected to the turbine for exhausting air from the turbine's interior, and thereby, drawing air into the turbine's interior, providing a first vent in the turbine for introducing the air into the turbine's interior, providing a second vent in the turbine at a diagonally opposite end of the turbine from the first vent for exhausting air from the turbine's interior, the air horn being inserted in the second vent, introducing a fog of the corrosion inhibitor into the air entering the first vent while the air horn is operating so that the corrosion inhibitor is caused to be drawn into and through the interior of the turbine to coat the interior component parts of the turbine, providing viewing covers on the turbine to observe the corrosion inhibitor being introduced through the first vent to determine whether the corrosion inhibitor has covered the interior component parts, and subsequently sealing all openings in the turbine with a plurality of covers to contain the corrosion inhibitor inside the turbine. The method further comprises providing the first vent on a first side of a first end of the turbine, and providing the second vent on a second side of a second end of the turbine, the second vent thereby being diagonally opposite the first vent so that the corrosion inhibitor is drawn into the first vent and diagonally through the turbine.

In a further exemplary embodiment of the invention, a method of applying a corrosion inhibitor to the interior component parts of a turbine to provide corrosion protection to the components comprises the steps of sealing each intake opening and each exhaust opening in the turbine with a cover, providing at least one inlet vent in the turbine, an intake cover or an exhaust cover for introducing air into the turbine's interior, providing a volume of corrosion inhibitor in a container that is connected to the at least one inlet vent, providing at least one outlet vent in the turbine, an intake cover or an exhaust cover at the opposite end of turbine from the at least one inlet vent for exhausting air from the turbine's interior, providing an air horn connected to the at least one exhaust vent for drawing air into and from the turbine's interior, introducing a fog of the corrosion inhibitor into the air entering the at least one inlet vent while the air horn is operating so that the corrosion inhibitor is caused to be drawn into and through the interior of the turbine to coat the interior component parts of the turbine, continuing to introduce the corrosion inhibitor into the at least one inlet vent until the fog of corrosion inhibitor coats the internal component parts of a turbine and appears at the at least one outlet vent and coats, and subsequently sealing all openings in the turbine to contain the corrosion inhibitor inside the turbine.

In yet another exemplary embodiment of the invention, a system for applying a corrosion inhibitor to the internal component parts of a turbine to provide corrosion protection to the components comprises at least one first cover for sealing the intake openings in the turbine to contain the corrosion inhibitor inside the turbine, at least one second cover for sealing the exhaust openings in the turbine to contain the corrosion inhibitor inside the turbine, an air horn for inducing within the turbine and exhausting from the turbine a stream of air, at least one inlet vent in the turbine, the first cover or the second cover for introducing the stream of air into the turbine's interior, at least one outlet vent in the turbine, the first cover or the second cover for exhausting the air from the turbine's interior, a container of corrosion inhibitor, a sprayer connected to the container of corrosion inhibitor for generating a fog of the corrosion inhibitor, the sprayer being inserted into the at least one inlet vent and introducing a fog of the corrosion inhibitor into the stream of air entering the at least one inlet vent while the air horn is operating so that the corrosion inhibitor is caused to be introduced into and throughout the interior of the turbine to coat the interior component parts of the turbine, and a valve on the air horn for discontinuing, when the fog of corrosion inhibitor is exhausted from the at least one outlet vent, the migration of the fog of corrosion inhibitor into the at least one inlet vent and throughout the interior of the turbine.

BRIEF DESCRIPTION OF THE DRAWINGS

The advantages of the present invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Several methods for applying corrosion inhibitor to the interior component parts of a gas (or steam) turbine to provide corrosion protection to the exposed surfaces of turbines' internal components are disclosed in commonly-assigned U.S. Pat. No. 6,841,195 B2 ("the '195 patent"). According to the methods disclosed in the '195 patent, a selected volume of corrosion inhibitor, such as a VCI product, is introduced into the interior components of the turbine with the corrosion inhibitor. The corrosion inhibitor product used with the methods disclosed in the '195 patent is Cortec's 337 VCI product.

The present invention is an improved method of introducing corrosion inhibitor into the interior of a turbine to provide corrosion protection for the interior component parts of the turbine. The preferred corrosion inhibitor product used with the method of the present invention is Cortec's 337 VCI GEN product, which is made using de-ionized water. This product carries the "GEN" designation, and is used to avoid any corrosion problems specific to the metals used in turbine hot gas paths.

Figure 1A:
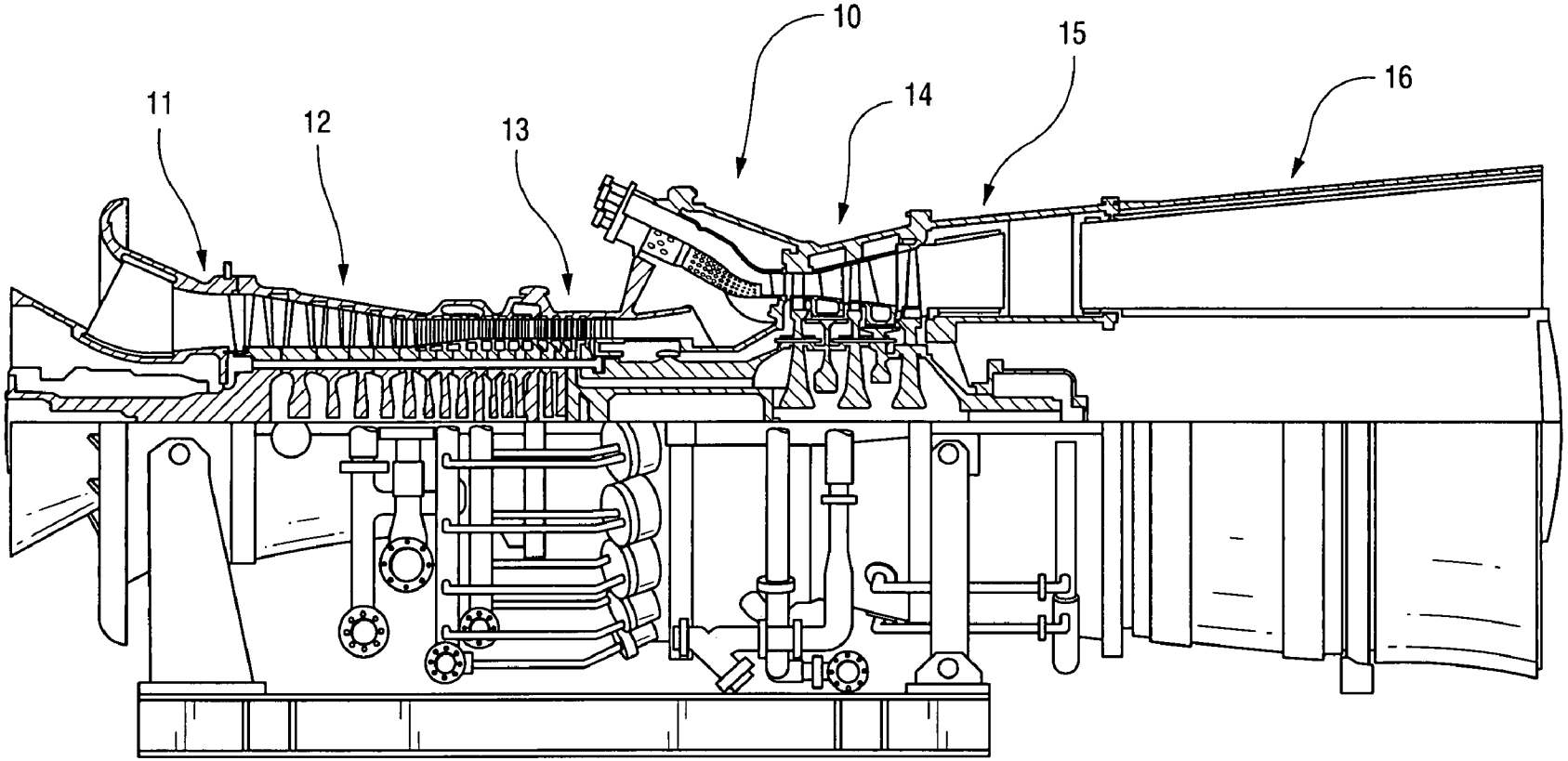
FIGS. 1A through 1D show a specific turbine, i.e., a General Electric model 7FA gas turbine, wherein according to the method of the present invention an airless sprayer and an air horn inserted through covers over the inlets and outlets of the gas turbine force a fog of corrosion inhibitor into the interior of the turbine so that the corrosion inhibitor coats the internal components of the turbine.

FIGS. 1A through 1D of the present application show a specific turbine 10, which is a General Electric model 7FA gas turbine, that has been prepared according to the method of the present invention for the introduction of a corrosion inhibitor into its interior to provide corrosion protection for its interior component parts. FIG. 1A is a partial cross-sectional view of turbine 10 shown in FIGS. 1B through 1D.

Figure 1B:
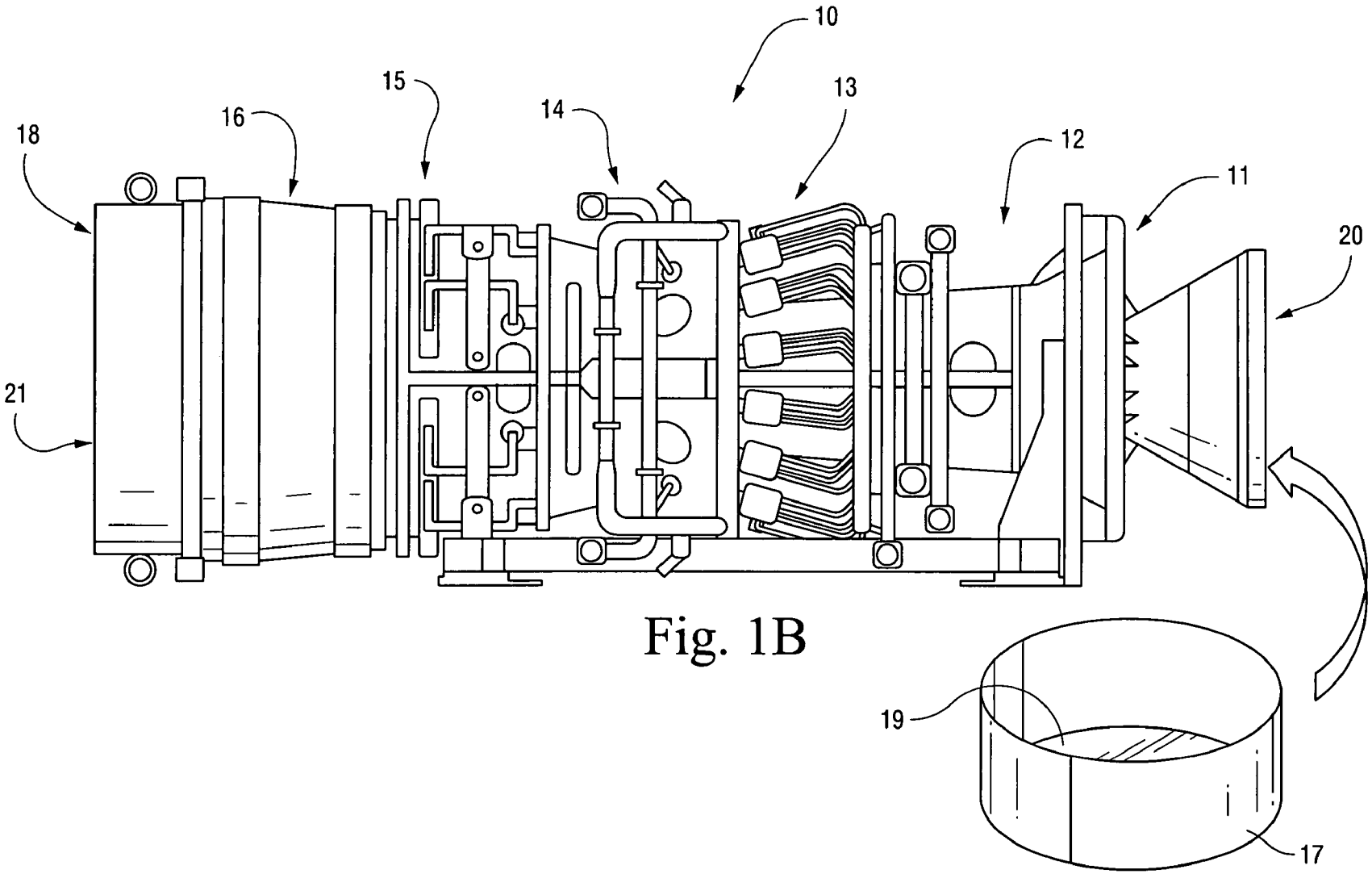
Figure 1C:
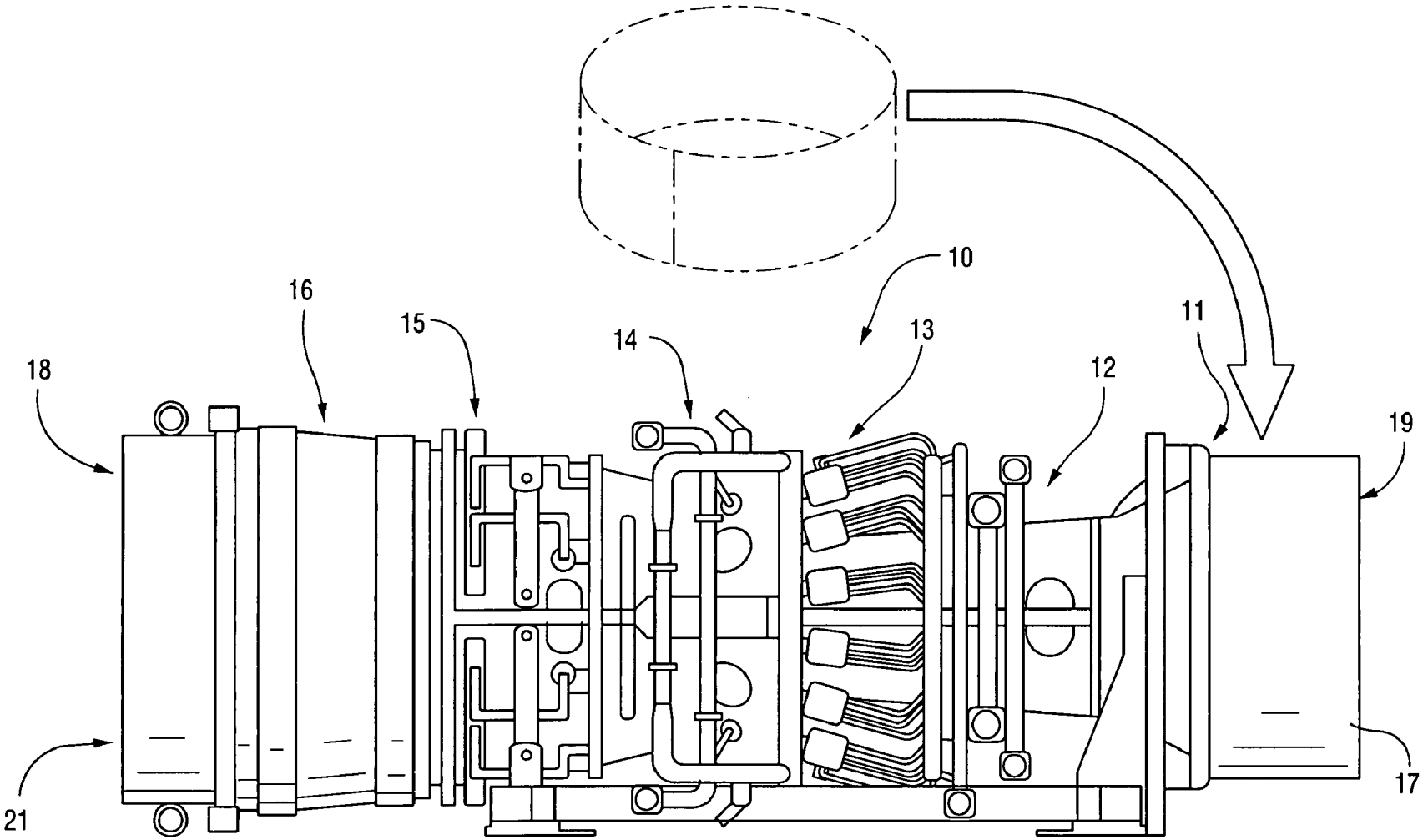
Figure 1D:
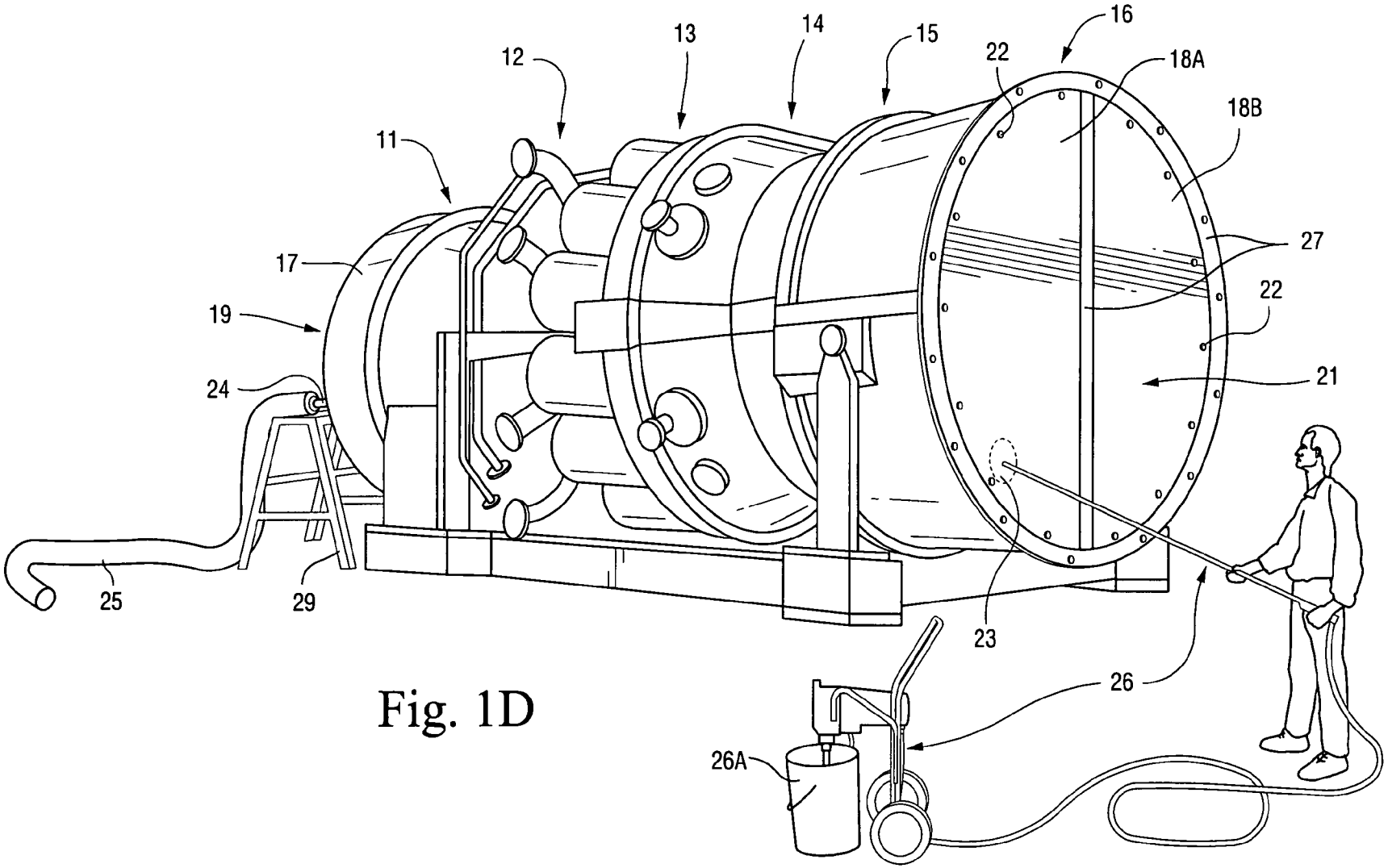

Turbine 10 includes an inlet casing 11, a compressor casing 12, a compressor discharge casing 13, a turbine casing 14, an exhaust frame 15 and an aft defuser 16. Also shown in FIGS. 1B through 1D are a metal cover 17 and corrugated black plastic covers 18A and 18B that are used to seal turbine 10 for the purpose of applying corrosion inhibitor to the internal components of turbine 10 to provide corrosion protection to the exposed surfaces of such components. According to the method of the present invention, metal cover 17, which is substantially in the shape of a cylinder with one end 19 closed, is placed over the open end 20 of inlet casing 11 to thereby seal open end 20. Preferably, all of the edges and seams of cover 17 are caulked to seal cover 17 over opening 20. A caulk, such as DOW all purpose caulk, can be used for this purpose.

At the opposite end of turbine 10, corrugated plastic covers 18A and 18B are bolted to the open end 21 of aft diffuser 16 using a plurality of bolts 22 inserted into bolt hole openings (not shown) in the end of aft diffuser 16, as shown in FIG. 1C. Preferably, corrugated plastic covers 18A and 18B are bolted to diffuser 16 using all of the bolt hole openings in diffuser 16 to ensure proper sealing of the open end 21 of diffuser 16. Preferably, all of the edges and seams of covers 18A and 18B are sealed using caulk and/or sealing gaskets appropriately positioned with respect to the edges and seams 27 of covers 18A and 18B. A gasket material, such as Gore-tex packing, can be used as the sealing gaskets.

To introduce the corrosion inhibitor into the interior of turbine 10, at least one inlet vent 23 is formed in metal cover 17 or corrugated plastic covers 18A or 18B. An air horn 24 for pulling a stream of air into and from the interior of turbine 10 is inserted into an outlet vent (not shown) formed at the opposite end of turbine 10, in metal cover 17 or in corrugated plastic covers 18A or 18B, as the case may be. Air horn 24 is then attached to an air hose 28 that pulls air from air horn 24 to induce the stream of air within turbine 10 and to an exhaust hose 25 which is appropriately positioned away from turbine 10 for proper venting of the corrosion inhibitor introduced into the interior of turbine 10. Preferably, air horn 24 is positioned at an appropriate height with respect to the outlet vent using a step stool 29, or the like, on which it can be propped.

An airless sprayer 26, inserted into inlet vent 23, is used to introduce a fog of the corrosion inhibitor into a stream of air entering inlet vent 23, while air horn 24 is operating so that the corrosion inhibitor is caused to be introduced into and through the interior of turbine 10 to coat the interior component parts of the turbine. Airless sprayer 26 is fed by a bucket 26A of the VCI corrosion inhibitor which is sucked into sprayer 26 for injection into the interior of turbine 10 through inlet vent 23.

According to the method of the present invention, the corrosion inhibitor is introduced into the interior of turbine 10, such that it saturates the area of the inlet vent with fog and such that vapors are induced to the opposite diagonal end of turbine 10 to thereby sufficiently coat the internal component parts of the turbine. A valve 28A (FIG. 3B) on air horn 24 is used to slow, regulate and/or discontinue the exit of the fog of corrosion inhibitor out of the turbine outlet vent. When the corrosion inhibitor is exhausted from the outlet vent and the amount of corrosion inhibitor coating the internal components of turbine 10 is verified as being sufficient through at least one plexiglass view port (not shown) in turbine 10, all openings of turbine 10 are then sealed to contain the corrosion inhibitor inside turbine 10.

Figure 2A:
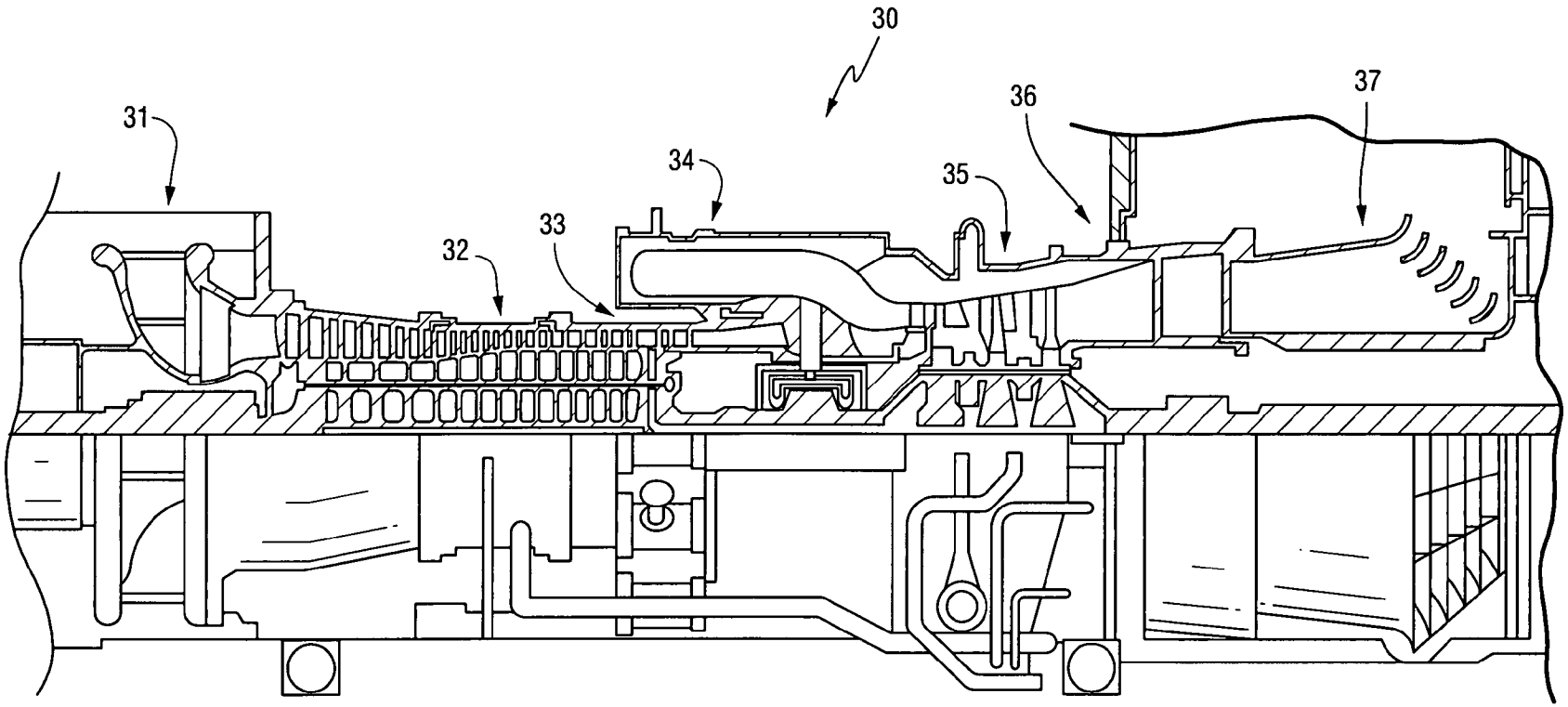
FIGS. 2A through 2C show a second specific turbine, i.e., a General Electric model 7EA gas turbine, wherein according to the method of the present invention an airless sprayer and an air horn inserted through the covers over the inlets and outlets of the gas turbine force a fog of corrosion inhibitor into the interior of the turbine so that the corrosion inhibitor coats the internal components of the turbine.
Figure 2B:
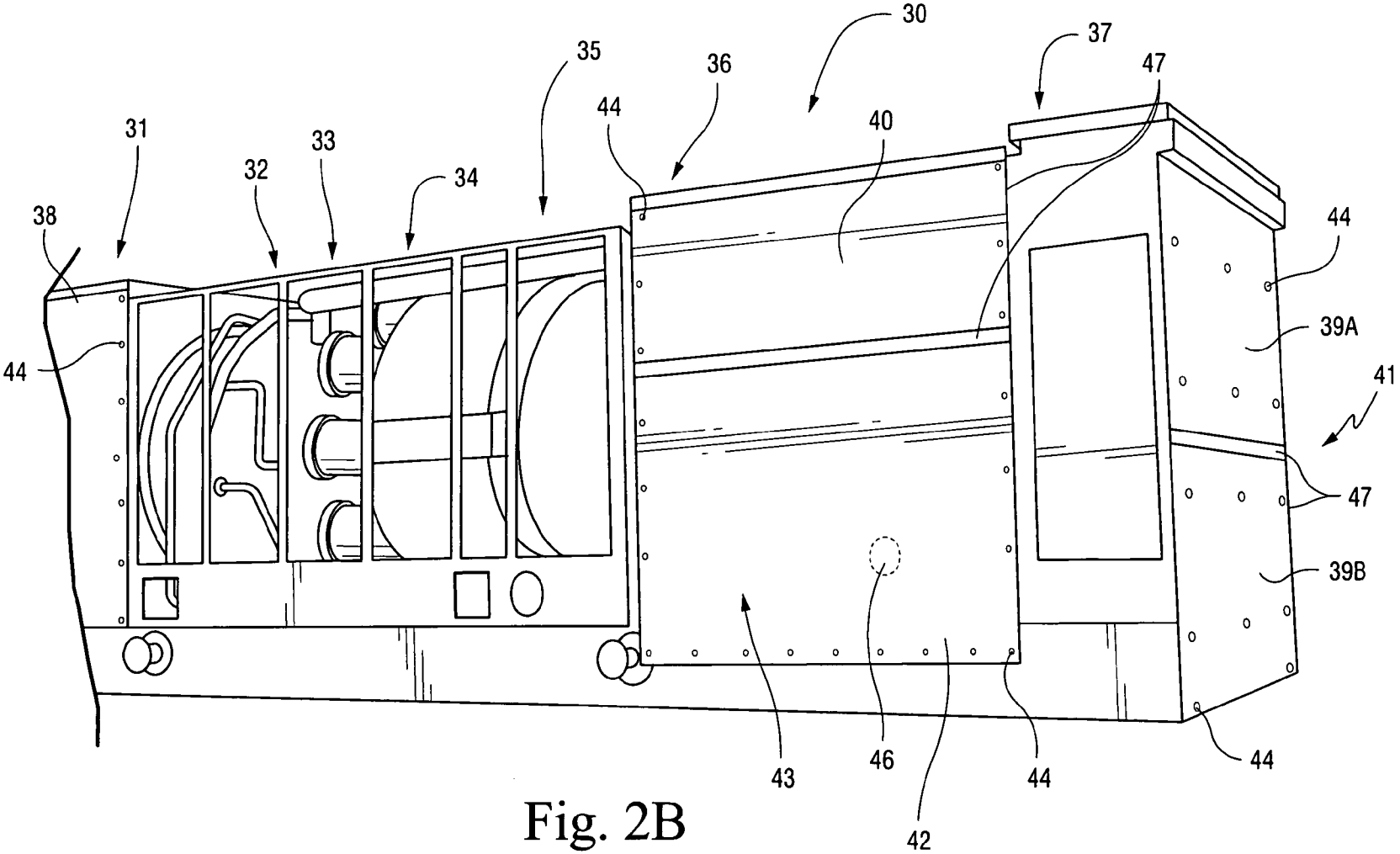
Figure 2C:
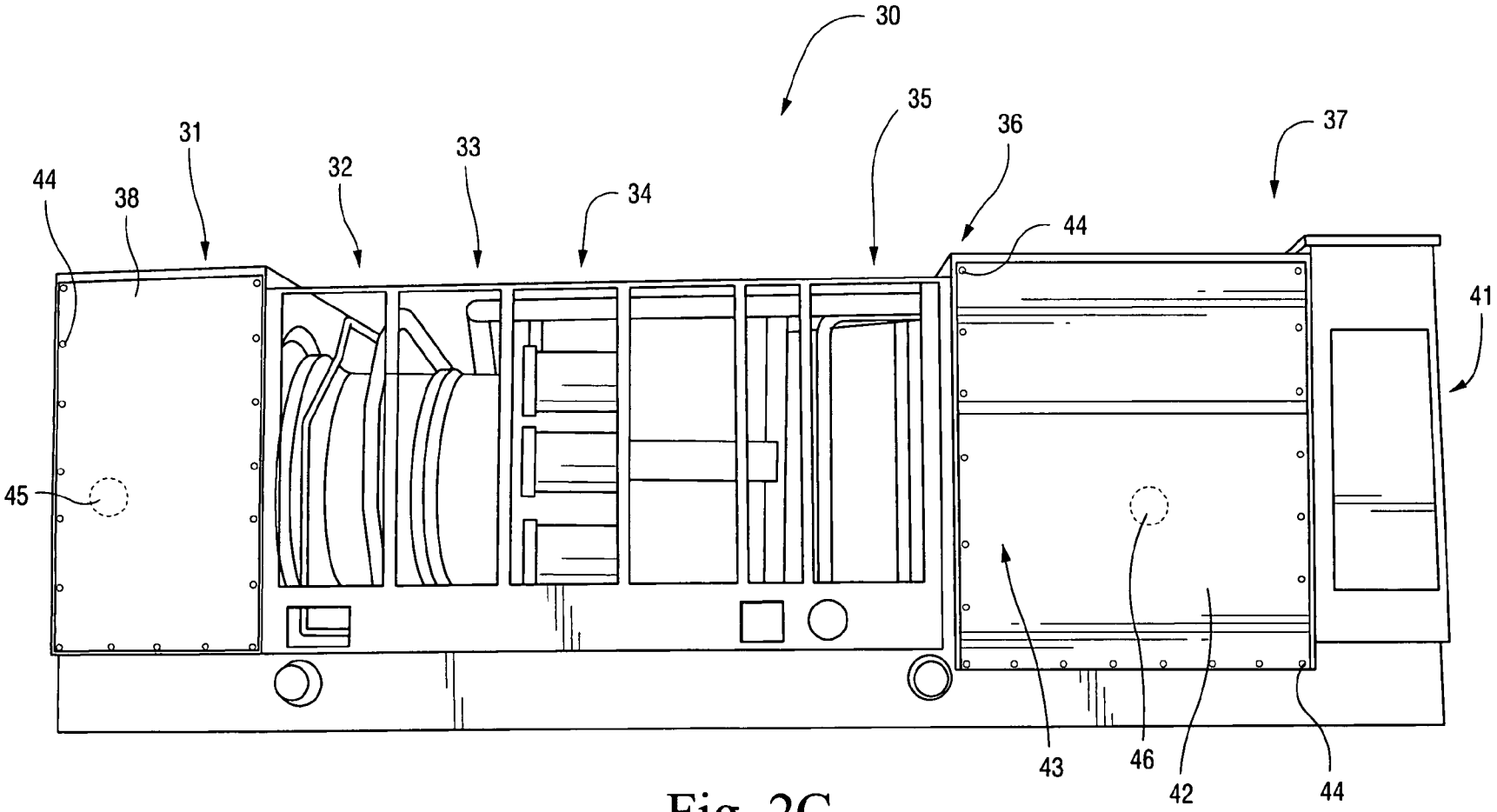

FIGS. 2A through 2C show a General Electric Model 7EA gas turbine 30. FIG. 2A is a partial cross-sectional view of gas turbine 30 shown in FIGS. 2B and 2C. Turbine 30 includes an inlet casing 31, a compressor casing 32, a compressor discharge 33, a compressor wrapper 34, a turbine casing 35, an exhaust frame 36, and an exhaust diffuser 37.

Shown in FIGS. 2B and 2C are a plurality of corrugated black plastic covers that are used to seal turbine 30 for the purpose of applying corrosion inhibitor to its internal components to provide corrosion protection to the exposed surfaces of turbine 30's internal components. A pair of corrugated plastic covers 39A and 39B seal the open end 41 of exhaust diffuser 37, while second pairs of plastic covers 40 and 42, only one pair of which are shown in FIGS. 2B and 2C, are used to seal the open sides 43 only one of which is shown in FIGS. 2B and 2C, of exhaust diffuser 37. Here again, plastic covers 39A, 39B, 40 and 42 are bolted to the open end 41 and open sides 43 of diffuser 37 using a plurality of bolts 44 inserted into bolt hole openings in the end and sides of diffuser 37. Here again, preferably, all of the edges and seams 47 of covers 39A, 39B, 40 and 42 are sealed using caulking and/or Gore-tex packing for sealing gaskets appropriately positioned with respect to the edges and seams of such covers.

To introduce the corrosion inhibitor into the interior of turbine 30, at least one inlet vent 45 is formed in a corrugated end plastic cover or a side plastic cover covering inlet casing 31 or aft diffuser 37. As shown in FIGS. 2B and 2C, inlet vent 45 is formed in plastic cover 38 covering one side of inlet casing 31.

Figure 3A:
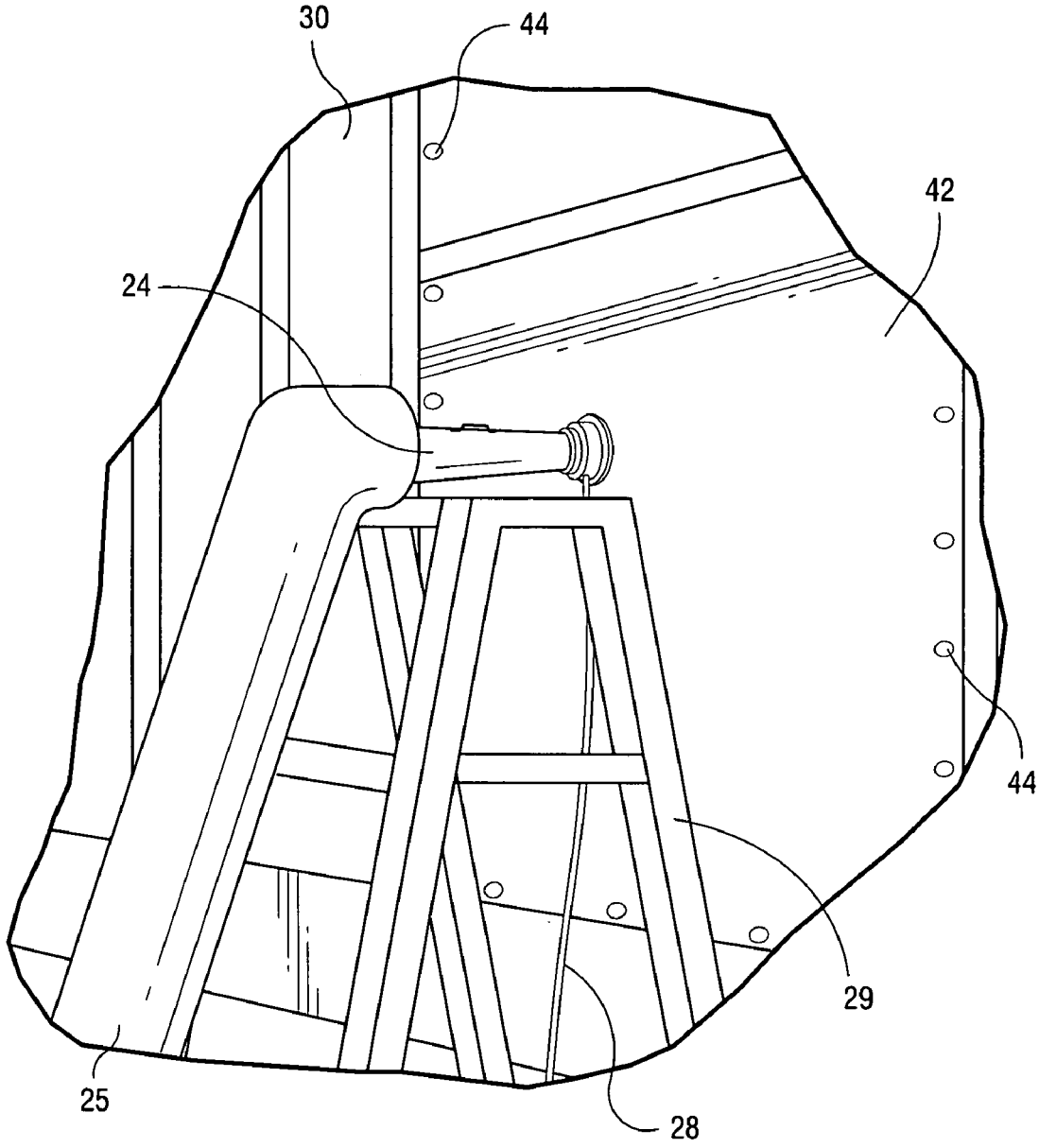
FIGS. 3A and 3B show an air horn for pulling a controlled stream of air into and from the interior of a turbine using a gate valve to regulate air flow.
Figure 3B:
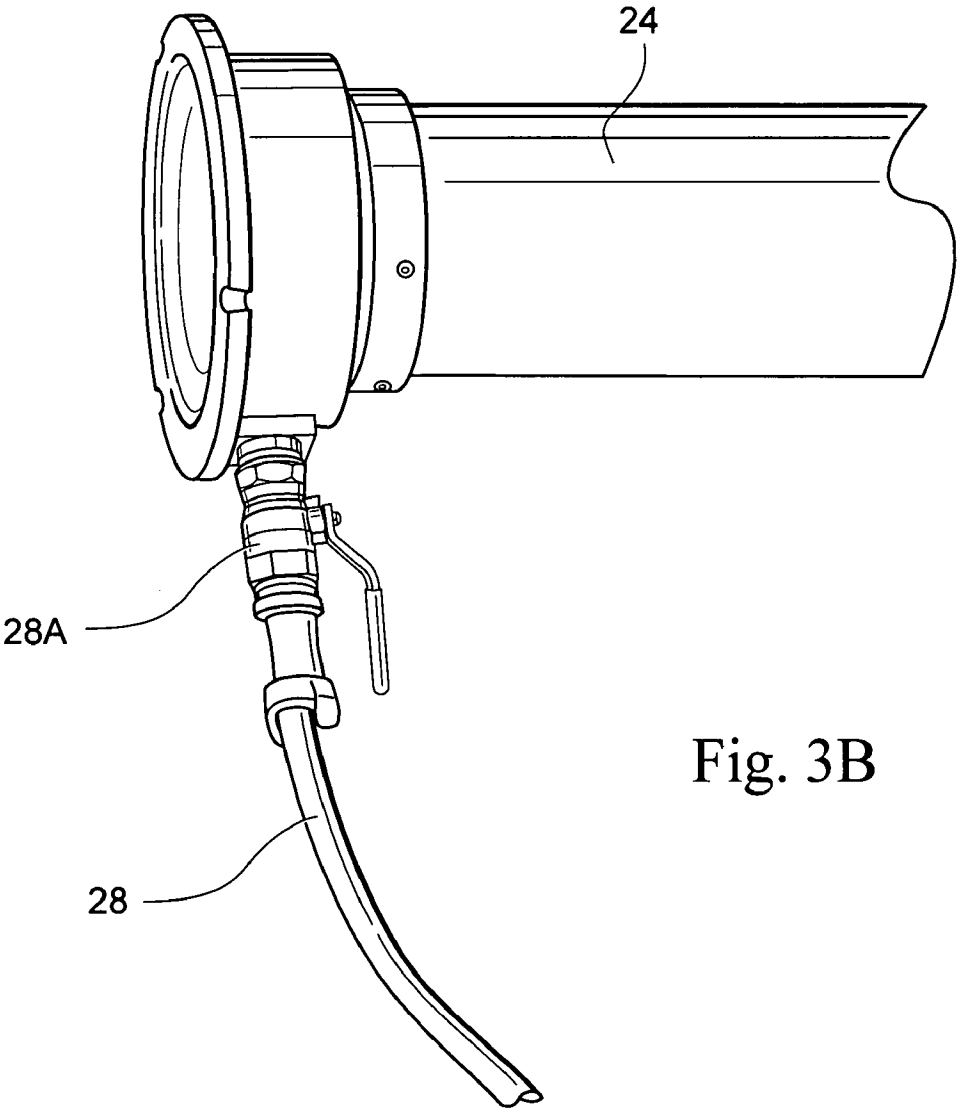
Figure 4A:
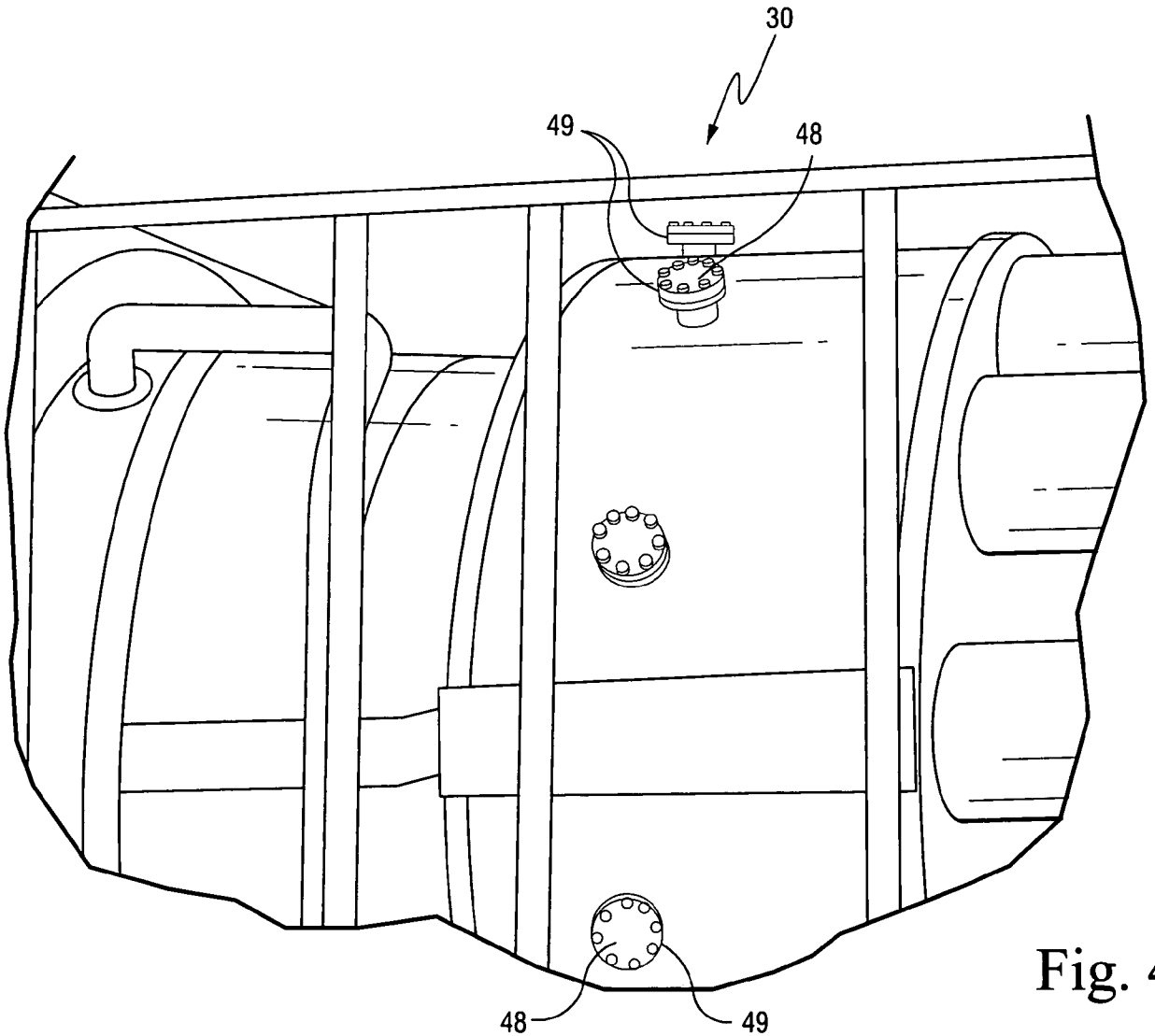
FIGS. 4A and 4B show plexiglass view ports in a turbine for verifying that the fog of corrosion inhibitor introduced into the turbine has sufficiently coated the internal components of the turbine.
Figure 4B:
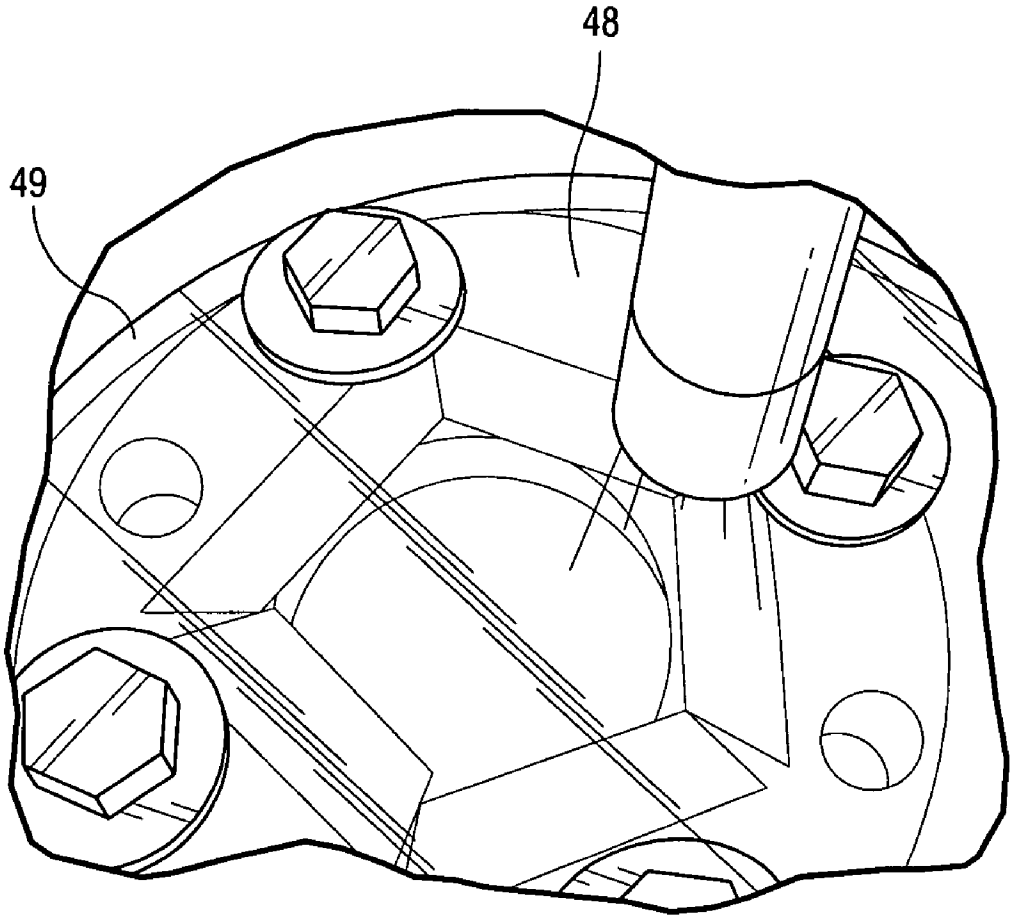

To pull a stream of air into and from the interior of turbine 30, air horn 24 is inserted into an outlet vent 46 formed in side plastic cover 42. Here again, as shown in FIGS. 3A and 3B, air horn 24 is attached to air hose 28 to induce the stream of air within turbine 10 hose 25 for proper venting of the corrosion inhibitor introduced into the interior of turbine 30. Airless sprayer 26 is inserted into inlet vent 45 formed in side plastic cover 38, and introduces a fog of the corrosion inhibitor into a stream of air entering inlet vent 45 while air horn 24 is operating so that the corrosion inhibitor is caused to be introduced into and throughout the interior of turbine 30 to coat the internal component parts of the turbine.

According to the method of the present invention, the corrosion inhibitor is introduced into the interior of turbine 30 such that it saturates the area of the inlet vent with fog and such that vapors are induced to the opposite diagonal end of turbine 30 to thereby sufficiently coat the interior component parts of the turbine. The valve on air horn 24 is again used to slow, regulate and/or discontinue the exit of the fog of corrosion inhibitor out of the turbine outlet vent 46 in cover 42.

When the corrosion inhibitor is exhausted from outlet vent 46 and the amount of corrosion inhibitor coating the internal components of turbine 10 is verified as being sufficient through a plexiglass view port 48 in blind flange openings 49 in turbine 30. All openings of turbine 30 are then sealed to contain the corrosion inhibitor inside turbine 30.

Figure 5A:
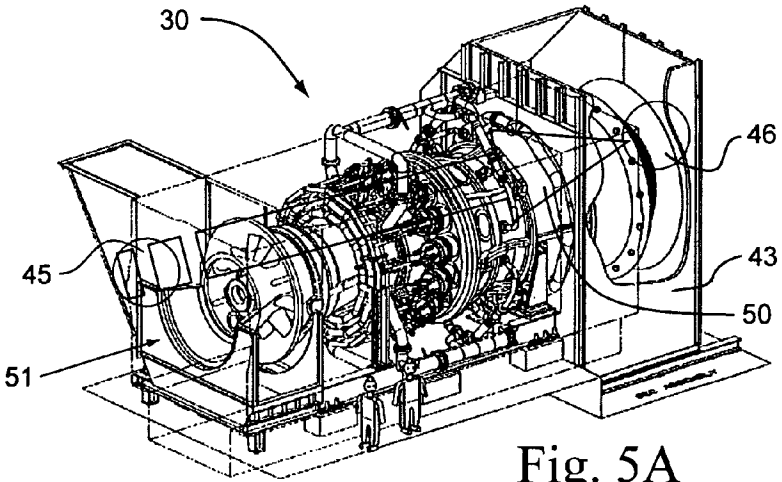
FIGS. 5A through 5D illustrate the method of the present invention wherein an airless sprayer and an air horn inserted through various locations in the inlet and outlet covers of a turbine cause corrosion inhibitor to be drawn into the interior of a gas turbine from a first one side at a first end of the turbine to a second, diagonally opposite, side at a second end of the turbine so that the inhibitor coats the internal components of the turbine.
Figure 5B:
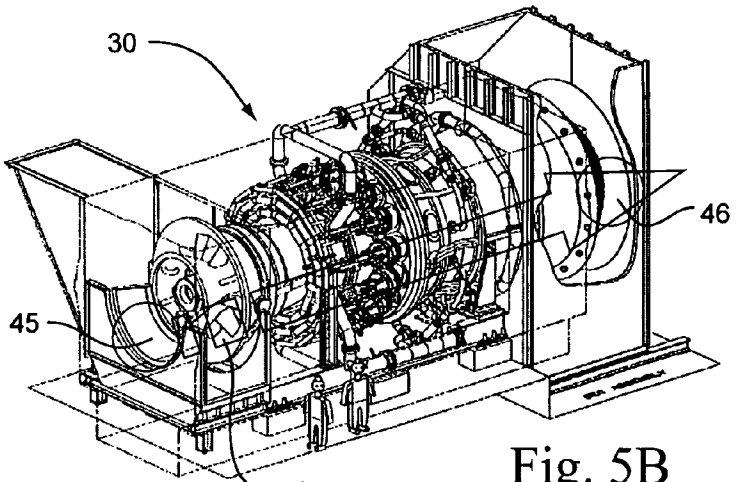
Figure 5C:
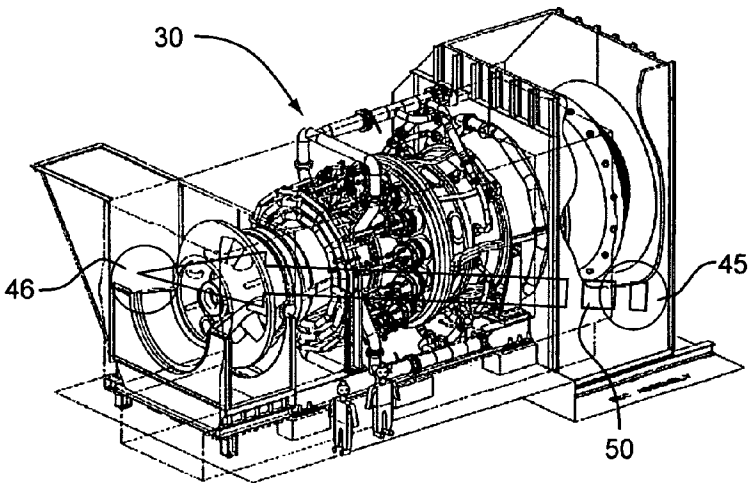

Referring now to FIGS. 5A through 5D, the corrosion inhibitor can be introduced into the interior of a turbine and induced to flow through the interior of the turbine by various pathways that are determined by the positioning of the inlet vent and the outlet vent at various locations with respect to the turbine. Preferably, the fog of corrosion inhibitor is introduced at a first inlet, where it saturates the internal area of the turbine adjacent to the inlet with the corrosion inhibitor, and is then induced to the opposite diagonal end of the turbine. FIGS. 5A and 5C are examples of where the fog of corrosion inhibitor is induced to the opposite diagonal end of turbine 30, by way of example. In FIG. 5A, the inlet vent 45 is positioned at a first end 51 of turbine 30, which is sealed with a corrugated plastic cover (not shown in FIG. 5A). The outlet vent 46 is positioned in side corrugated plastic cover 42 shown in FIGS. 2B and 2C. With airless sprayer 26 inserted into inlet vent 45 and air horn 24 inserted into outlet vent 46, the corrosion inhibitor fog 50 is caused to migrate from one side of first end 51 to the opposite diagonal end of side opening 43. In FIG. 5C, the positioning of inlet vent 45 and outlet vent 46 is reversed so that the migration of fog 50 is reversed with respect to that shown in FIG. 5A.

Figure 5D:
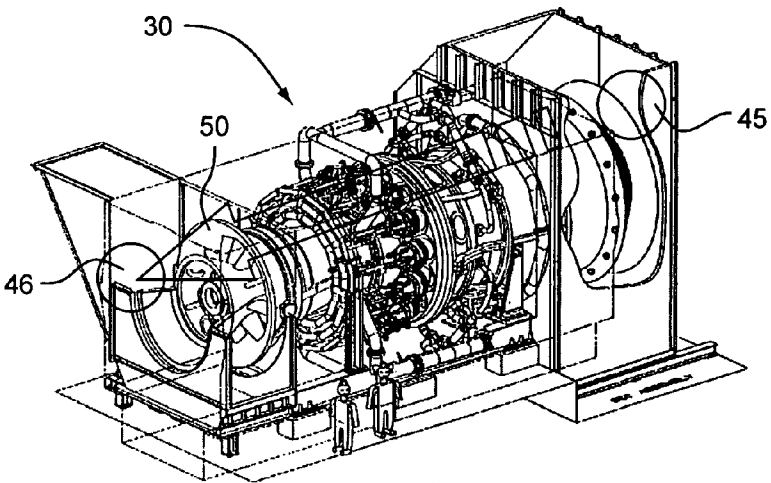

FIGS. 5B and 5D show alternative methods of inducing the migration of the corrosion inhibitor fog 50 within the interior of a turbine, again, such as turbine 30, by way of example. In FIG. 5B, the inlet vent 45 is positioned on one side of first end 51, while the outlet vent 46 is positioned on the same side as vent 45, but on plastic cover 39B covering part of open end 41 of turbine 30. In this instance, corrosion inhibitor 50 does not migrate diagonally through the interior of turbine 30, but rather on the same side as where vents 45 and 46 are positioned. In the arrangement shown in FIG. 5D, the positioning of vents 45 and 46 are reversed so that the migration of fog 50 is reversed, but again on the same side of turbine 30 as occurs in the arrangement of FIG. 5B.

It should be noted that the positioning of the inlet and outlet vents and the number of inlet and outlet vents used can be varied to ensure the desired amount of coverage of the internal components of a turbine by the corrosion inhibitor. Thus, it is possible to use multiple applications of the corrosion inhibitor fog through multiple input vents to ensure sufficient coverage of the internal components by the corrosion inhibitor. As the input vents are varied, it is also possible to vary the location of the outlet vents to achieve a desired migration of the corrosion inhibitor fog for sufficient soaking of the internal components with the corrosion inhibitor. Once the corrosion inhibitor has been introduced into the interior of a turbine using first inlet and outlet vents to coat the interior component parts of the turbine, the selection of vents, and thus the positioning of the air horn and sprayer, are then typically altered to allow a reverse flow of the corrosion inhibitor fog to again saturate the turbine internals with the corrosion inhibitor.

The method of the present invention for applying corrosion inhibitor to the interior of gas turbines after final assembly and the test to prevent corrosion of internal hardware during shipping and storage and prior to initial startup can also be used during any extended shutdown of the turbine. In that situation, the corrosion inhibitor would again be introduced into the interior of a turbine through the inlet vent formed in the covers covering the inlets or outlets of the turbine in a manner so as to force or draw the corrosion inhibitor completely through the interior of the turbine in the manner desired to achieve sufficient soaking of the internal components by the corrosion inhibitor. Here again, preferably this is accomplished by inducing the corrosion inhibitor fog to migrate from a first side of a first end of the turbine to a second, diagonally opposite, side of a second end of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of applying a corrosion inhibitor to the interior component parts of a turbine to provide corrosion protection to the components, the method comprising the steps of:

sealing each intake opening and each exhaust opening in the turbine with a cover, forming at least one intake port one and at least one exhaust port in the intake opening seals and the exhaust opening seals, respectively, and drawing a stream of air into the turbine's interior through the at least one intake port, airlessly spraying a fog of the corrosion inhibitor into the stream of air drawn into the turbine so that the corrosion inhibitor is caused to be drawn into and throughout the interior of the turbine to coat the interior component parts of the turbine, drawing the fog of corrosion inhibitor and the stream of air being drawn into the turbine's interior out of the turbine through the at least one exhaust port, and subsequently sealing each opening in the turbine with a cover to contain the corrosion inhibitor inside the turbine.

2. The method of claim 1 wherein the fog of corrosion inhibitor is introduced into the stream of air drawn into the turbine using an airless sprayer inserted into the at least one intake port.

3. The method of claim 1 wherein the corrosion inhibitor is a volatile corrosion inhibitor product.

4. The method of claim 1 wherein the step of drawing the corrosion inhibitor into the interior of the turbine is performed until the corrosion inhibitor coats substantially all exposed surfaces of the components inside the turbine.

5. The method of claim 1 wherein each cover is made from a material selected from the group consisting of plastic and metal.

6. The method of claim 1 wherein the turbine includes a plurality of openings covered by a plurality of covers, and wherein the covers are made from a combination of materials selected from the group consisting of plastic and metal.

7. The method of claim 1, wherein the corrosion inhibitor is made using de-ionized water.

8. The method of claim 1, wherein each cover sealing each intake opening and each exhaust opening in the turbine is caulked to seal said openings.

9. A method of applying a corrosion inhibitor to the interior component parts of a turbine to provide corrosion protection to the components, the method comprising the steps of:

providing an air horn connected to the turbine for exhausting air from the turbine's interior, and thereby, drawing air into the turbine's interior, providing a first vent in the turbine for introducing the air into the turbine's interior, providing a second vent in the turbine at a diagonally opposite end of the turbine from the first vent for exhausting air from the turbine's interior, the air horn being inserted in the second vent, introducing a fog of the corrosion inhibitor into the air entering the first vent while the air horn is operating so that the corrosion inhibitor is caused to be drawn into and through the interior of the turbine to coat the interior component parts of the turbine, providing viewing covers on the turbine to observe the corrosion inhibitor being introduced through the first vent to determine whether the corrosion inhibitor has covered the interior component parts, and subsequently sealing all openings in the turbine with a plurality of covers to contain the corrosion inhibitor inside the turbine.

10. The method of claim 9 wherein the fog of corrosion inhibitor is provided using an airless sprayer that is connected to the first vent.

11. The method of claim 9 wherein the corrosion inhibitor is a volatile corrosion inhibitor product.

12. The method of claim 9 wherein the air horn is connected to the second vent so that the fog of corrosion inhibitor is drawn into the turbine through the first vent.

13. The method of claim 9 wherein the step of introducing the fog of corrosion inhibitor into the first vent is performed so that the fog of corrosion inhibitor appears at the second vent diagonally opposite the first vent within the turbine.

14. The method of claim 9 wherein the step of introducing the fog of corrosion inhibitor into the first vent is performed until the corrosion inhibitor coats substantially all exposed surfaces of the components inside the turbine.

15. The method of claim 9 further comprising providing a metal cover over the turbine's inlet, the metal cover containing the first vent through which the corrosion inhibitor is drawn into the interior of the turbine while the air horn is operating connected to the second vent.

16. The method of claim 9 further comprising providing the first vent on a first side of a first end of the turbine, and providing the second vent on a second side of a second end of the turbine, the second vent thereby being diagonally opposite the first vent so that the corrosion inhibitor is drawn into the first vent and diagonally through the turbine.

17. The method of claim 9 further comprising providing a corrugated plastic cover covering the turbine's exhaust diffuser in which the first vent is formed so that the corrosion inhibitor is forced into the first vent while the air horn is operating while connected to the second vent, the second vent being formed in a metal cover covering the turbine's inlet casing.

18. The method of claim 9 wherein the covers are made from a material selected from the group consisting of plastic and metal.

19. The method of claim 18 wherein the covers are made from corrugated plastic.

20. The method of claim 9 wherein the covers are made from a combination of materials selected from the group consisting of plastic and metal.

21. The method of claim 9 further comprising the step of caulking the edges and seams of the covers to seal the covers over the turbine exhaust and intake openings.

22. The method of claim 21 wherein the caulk is all purpose caulk.

23. The method of claim 9 further comprising the step of sealing the edges and seams of the covers using caulk and/or sealing gaskets.

24. The method of claim 9 further comprising the step of bolting the covers over the exhaust and intake openings to seal the covers over said openings.

25. The method of claim 9 further comprising the steps of, prior to sealing all openings in the turbine with a plurality of covers to contain the corrosion inhibitor inside the turbine:

providing a third vent in the turbine for introducing the air into the turbine's interior, providing a fourth vent in the turbine at a diagonally opposite end of the turbine from the third vent for exhausting air from the turbine's interior, the air horn being inserted in the fourth vent, and introducing a fog of the corrosion inhibitor into the air entering the third vent while the air horn is operating so that the corrosion inhibitor is caused to be drawn into and through the interior of the turbine in an opposite direction to coat further the interior component parts of the turbine.

26. A method of applying a corrosion inhibitor to the internal component parts of a turbine to provide corrosion protection to the components, the method comprising the steps of:

sealing each intake opening and each exhaust opening in the turbine with a cover, providing at least one inlet vent in the turbine, an intake cover or an exhaust cover for introducing air into the turbine's interior, providing a volume of corrosion inhibitor in a container that is connected to the at least one inlet vent, providing at least one outlet vent in the turbine, an intake cover or an exhaust cover at the opposite end of turbine from the at least one inlet vent for exhausting air from the turbine's interior, providing an air horn connected to the at least one exhaust vent for drawing air into and from the turbine's interior, introducing a fog of the corrosion inhibitor into the air entering the at least one inlet vent while the air horn is operating so that the corrosion inhibitor is caused to be drawn into and through the interior of the turbine to coat the interior component parts of the turbine, continuing to introduce the corrosion inhibitor into the at least one inlet vent until the fog of corrosion inhibitor coats the internal component parts of a turbine and appears at the at least one outlet vent, and subsequently sealing all openings in the turbine to contain the corrosion inhibitor inside the turbine.

27. The method of claim 26 wherein the corrosion inhibitor is a volatile corrosion inhibitor product.

28. The method of claim 26 wherein the air horn is connected to the outlet vent so that the fog of corrosion inhibitor is drawn into the inlet vent and through the turbine to coat the internal component parts of the turbine.

29. The method of claim 28 wherein the caulk is all purpose caulk.

30. The method of claim 26 wherein the step of introducing the fog of corrosion inhibitor into the inlet vent is performed until the fog of corrosion inhibitor appears at the outlet vent, and wherein the method further comprises providing a view port in the turbine for viewing the interior of the turbine to verify that the corrosion inhibitor has coated substantially all exposed surfaces of the components inside the turbine.

31. The method of claim 26 wherein the step of introducing the fog of corrosion inhibitor into the inlet vent is performed until the corrosion inhibitor coats substantially all exposed surfaces of the components inside the turbine.

32. The method of claim 26 further comprising providing a metal cover over the turbine's inlet, the metal cover containing the inlet vent through which the corrosion inhibitor is drawn into the interior of the turbine while the air horn is operating connected to the exhaust vent.

33. The method of claim 32 wherein the covers are made from corrugated plastic.

34. The method of claim 26 further comprising providing the inlet vent on a first side of a first end of the turbine, and providing the exhaust vent on a second side of a second end of the turbine, the exhaust vent thereby being diagonally opposite the inlet vent so that the corrosion inhibitor is drawn into the inlet vent and diagonally through the turbine.

35. The method of claim 26 further comprising the step of caulking the edges and seams of the covers to seal the covers over the exhaust and intake openings.

36. The method of claim 26 further comprising the step of sealing the edges and seams of the covers using caulk and/or sealing gaskets.

37. The method of claim 26 wherein the covers are made from a material selected from the group consisting of plastic and metal.

38. The method of claim 26 wherein the covers are made from a combination of materials selected from the group consisting of plastic and metal.

39. The method of claim 26 further comprising the step of bolting the covers over the exhaust and intake openings to seal the covers over said openings.

40. The method of claim 26 further comprising the steps of, prior to sealing all openings in the turbine with a plurality of covers to contain the corrosion inhibitor inside the turbine:

providing at least one second inlet vent in the turbine at an end opposite the at least one inlet vent, providing at least one second outlet vent in the turbine at the opposite end of turbine from the second at least one inlet vent for exhausting air from the turbine's interior, and introducing a second fog of the corrosion inhibitor into the air entering the second at least one inlet vent while the air horn is operating so that the corrosion inhibitor is caused to be drawn into and through the interior of the turbine in an opposite direction to coat further the interior component parts of the turbine.

* * * * *